US006488430B1

(12) United States Patent
Jimenez

(10) Patent No.: US 6,488,430 B1
(45) Date of Patent: Dec. 3, 2002

(54) WRITING UTENSIL AND CREDIT INFORMATION STORAGE COMBINATION

(76) Inventor: Carlos D. Jimenez, 10430 Garfield Ave., South Gate, CA (US) 90280

( * ) Notice: Subject to any disclaimer, the term of this patent is extended or adjusted under 35 U.S.C. 154(b) by 0 days.

(21) Appl. No.: 09/928,084

(22) Filed: Aug. 10, 2001

(51) Int. Cl.[7] ..... B43K 29/00
(52) U.S. Cl. ..... 401/195
(58) Field of Search ..... 401/52, 195; 40/334, 40/DIG. 36, DIG. 37

(56) References Cited

U.S. PATENT DOCUMENTS

| | | | | |
|---|---|---|---|---|
| 3,972,138 | A | | 8/1976 | Armbruster |
| 4,149,812 | A | | 4/1979 | Huffman |
| D280,214 | S | | 8/1985 | Opel |
| 4,620,727 | A | | 11/1986 | Stockburger |
| 4,751,741 | A | * | 6/1988 | Mochinaga et al. ..... 382/13 |
| 5,103,486 | A | * | 4/1992 | Grippi ..... 382/4 |
| 5,107,541 | A | * | 4/1992 | Hilton ..... 382/3 |
| 5,294,792 | A | * | 3/1994 | Lewis et al. ..... 250/221 |
| 5,561,282 | A | * | 10/1996 | Price et al. ..... 235/380 |
| 5,678,939 | A | | 10/1997 | Ross |
| 5,769,213 | A | | 6/1998 | Chatterton |
| 5,774,602 | A | * | 6/1998 | Taguchi et al. ..... 382/314 |
| 6,119,944 | A | * | 9/2000 | Mulla et al. ..... 235/472.03 |

* cited by examiner

*Primary Examiner*—Gregory Huson
*Assistant Examiner*—Huyen Le

(57) ABSTRACT

A writing utensil and credit information storage combination for combining a writing utensil with credit information such that each is readily available. The writing utensil and credit information storage combination includes a writing utensil having a first end and a second end. A storage medium for storing credit information is attached to the writing utensil. A reading means reads the information on the storage medium.

8 Claims, 4 Drawing Sheets

FIG. 1
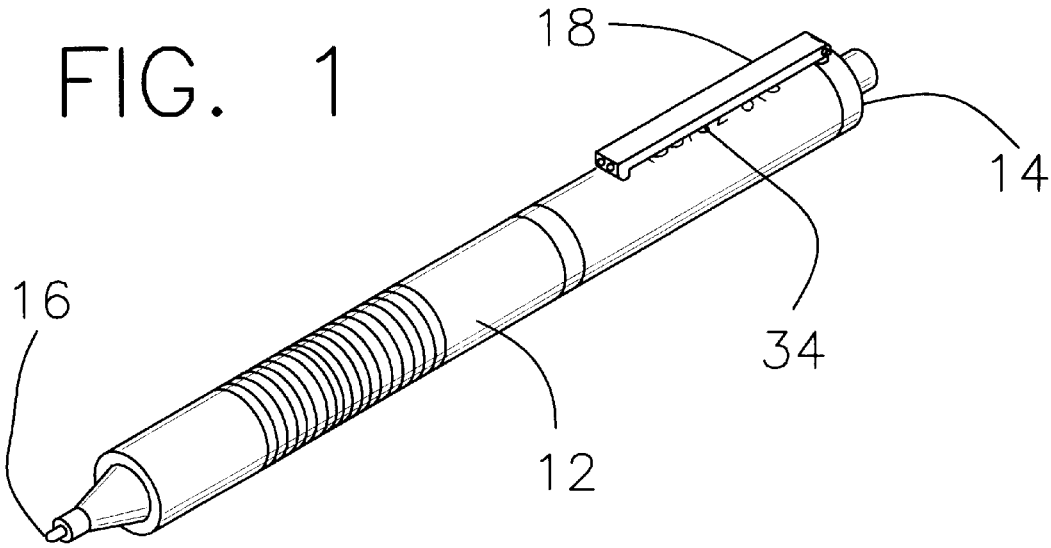
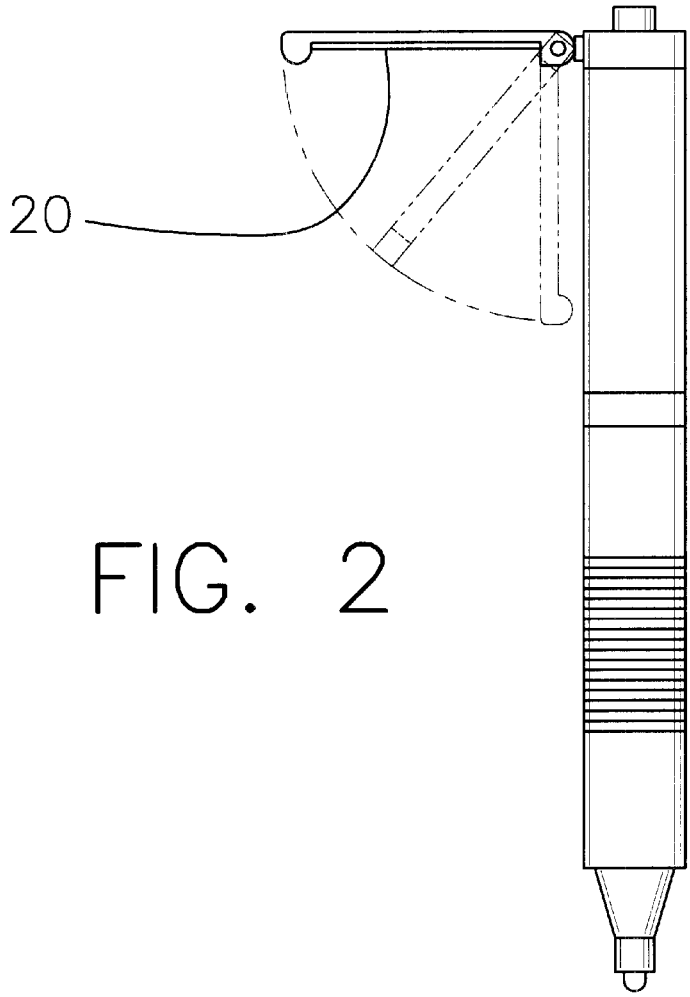
FIG. 2

WRITING UTENSIL AND CREDIT INFORMATION STORAGE COMBINATION

BACKGROUND OF THE INVENTION

1. Field of the Invention

The present invention relates to credit information storage devices and more particularly pertains to a new writing utensil and credit information storage combination for combining a writing utensil with credit information such that each is readily available.

2. Description of the Prior Art

The use of credit information storage devices is known in the prior art. More specifically, credit information storage devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,149,812; U.S. Pat. No. 5,769,213; U.S. Pat. No. 4,620,727; U.S. Pat. No. 3,972,138; U.S. Pat. No. 5,678,939; and U.S. Pat. No. Des. 280,214.

While these devices fulfill their respective, particular objectives and requirements, the aforementioned patents do not disclose a new writing utensil and credit information storage combination. The inventive device includes a writing utensil having a first end and a second end. A storage medium for storing credit information is attached to the writing utensil. A reading means reads the information on the storage medium.

In these respects, the writing utensil and credit information storage combination according to the present invention substantially departs from the conventional concepts and designs of the prior art, and in so doing provides an apparatus primarily developed for the purpose of combining a writing utensil with credit information such that each is readily available.

SUMMARY OF THE INVENTION

In view of the foregoing disadvantages inherent in the known types of credit information storage devices now present in the prior art, the present invention provides a new writing utensil and credit information storage combination construction wherein the same can be utilized for combining a writing utensil with credit information such that each is readily available.

The general purpose of the present invention, which will be described subsequently in greater detail, is to provide a new writing utensil and credit information storage combination apparatus and method which has many of the advantages of the credit information storage devices mentioned heretofore and many novel features that result in a new writing utensil and credit information storage combination which is not anticipated, rendered obvious, suggested, or even implied by any of the prior art credit information storage devices, either alone or in any combination thereof.

To attain this, the present invention generally comprises a writing utensil having a first end and a second end. A storage medium for storing credit information is attached to the writing utensil. A reading means reads the information on the storage medium.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new writing utensil and credit information storage combination apparatus and method which has many of the advantages of the credit information storage devices mentioned heretofore and many novel features that result in a new writing utensil and credit information storage combination which is not anticipated, rendered obvious, suggested, or even implied by any of the prior art credit information storage devices, either alone or in any combination thereof.

It is another object of the present invention to provide a new writing utensil and credit information storage combination which may be easily and efficiently manufactured and marketed.

It is a further object of the present invention to provide a new writing utensil and credit information storage combination which is of a durable and reliable construction.

An even further object of the present invention is to provide a new writing utensil and credit information storage combination which is susceptible of a low cost of manufacture with regard to both materials and labor, and which accordingly is then susceptible of low prices of sale to the consuming public, thereby making such writing utensil and credit information storage combination economically available to the buying public.

Still yet another object of the present invention is to provide a new writing utensil and credit information storage combination which provides in the apparatuses and methods of the prior art some of the advantages thereof, while simultaneously overcoming some of the disadvantages normally associated therewith.

Still another object of the present invention is to provide a new writing utensil and credit information storage combination for combining a writing utensil with credit information such that is readily available.

Yet another object of the present invention is to provide a new writing utensil and credit information storage combination which includes a writing utensil having a first end and a second end. A storage medium for storing credit information is attached to the writing utensil. A reading means reads the information on the storage medium.

Still yet another object of the present invention is to provide a new writing utensil and credit information storage combination that gives a person the advantage of combining their credit card type information to being combined with a writing utensil.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new writing utensil and credit information storage combination according to the present invention.

FIG. 2 is a schematic side view of the present invention.

DESCRIPTION OF THE PREFERRED EMBODIMENT

Figure 3:
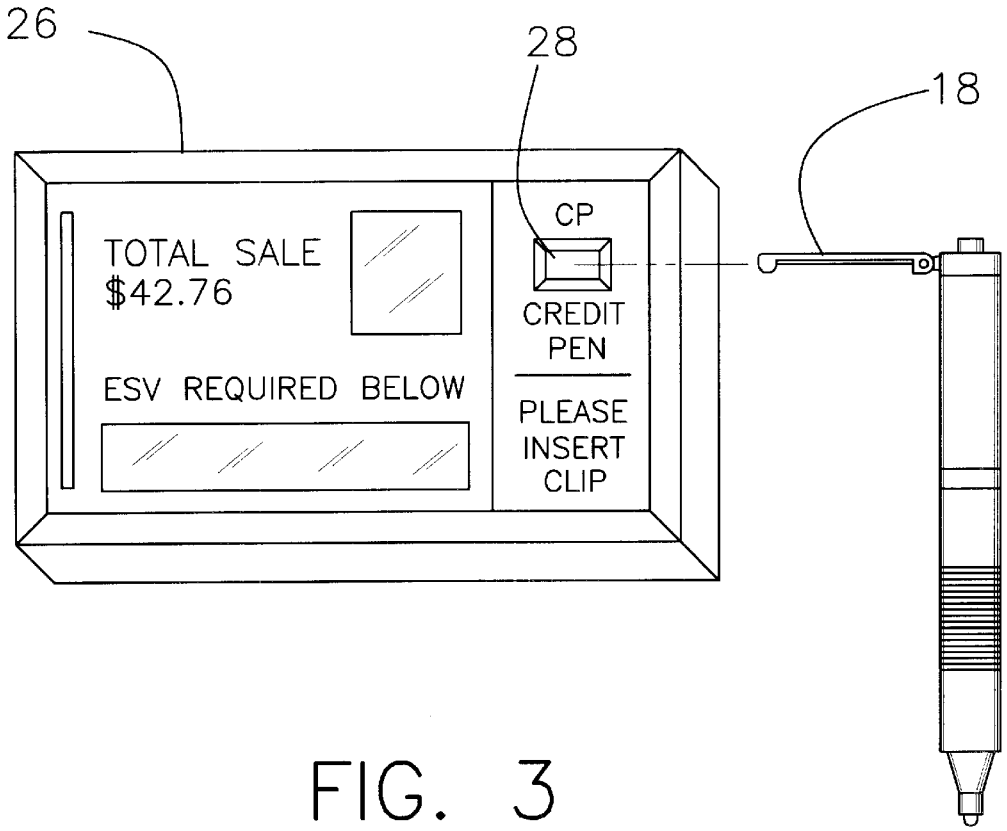
FIG. 3 is a schematic perspective view of the first embodiment of the present invention.

With reference now to the drawings, and in particular to FIGS. 1 through 5 thereof, a new writing utensil and credit information storage combination embodying the principles and concepts of the present invention and generally designated by the reference numeral 10 will be described.

As best illustrated in FIGS. 1 through 5, the writing utensil and credit information storage combination 10 generally comprises a writing utensil 12 having a first end 14 and a second end 16. The second end 16 defines an ink delivering portion. A clip 18 is pivotally coupled to the first end of the writing utensil 12. The writing utensil 12 is generally a conventional pen.

Figure 4:
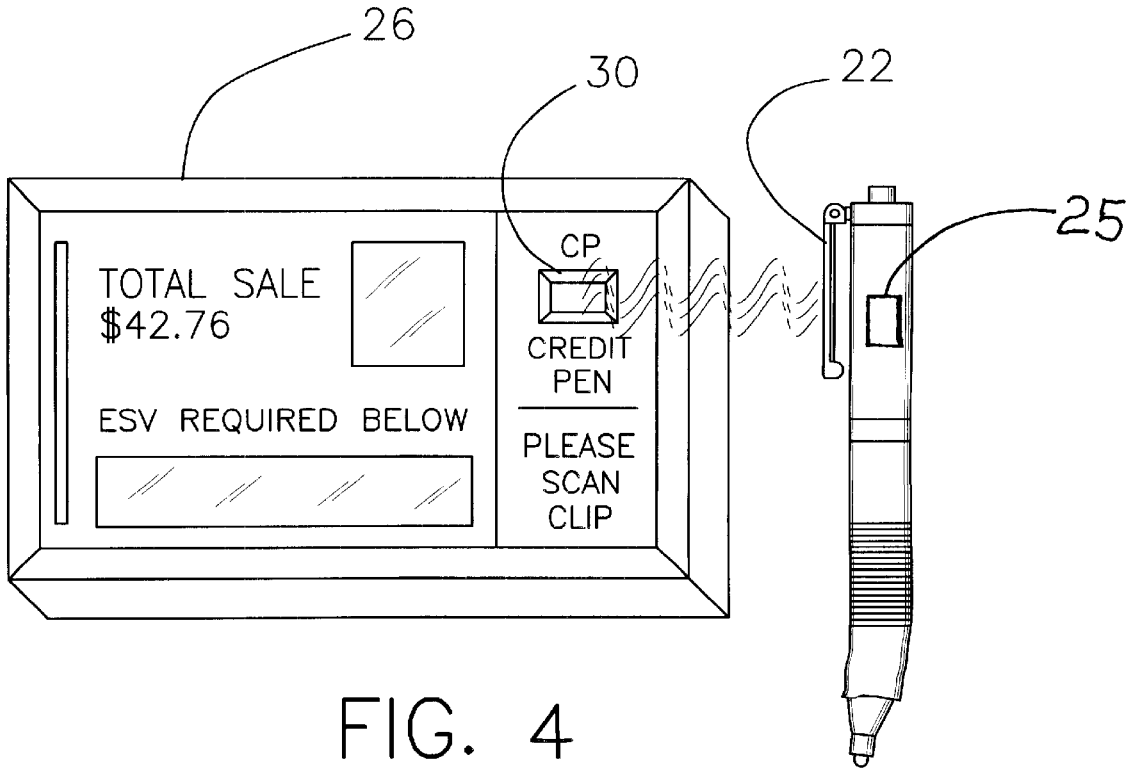
FIG. 4 is a schematic perspective view of the second embodiment of the present invention.
Figure 5:
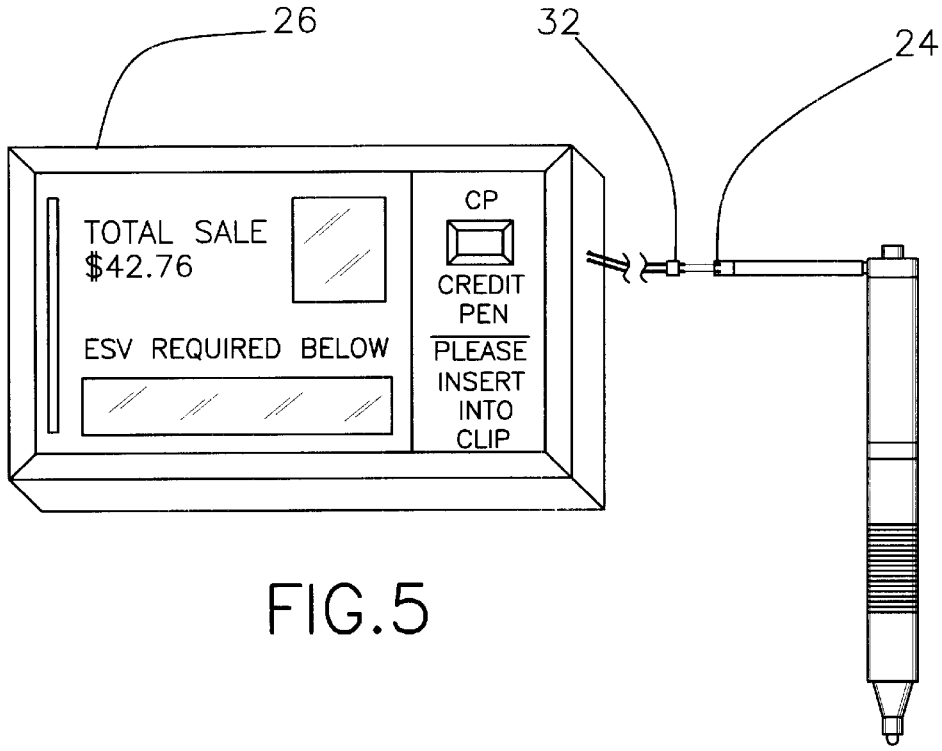
FIG. 5 is a schematic perspective view of the third embodiment of the present invention.

A storage medium for storing credit information is attached to the clip. Ideally, the storage medium comprises a magnetic strip 20 of the type found on conventional credit cards. Alternatively, FIG. 4 depicts a transmitting device 22 for transmitting by wireless means the stored information from a conventional microchip 25 either mounted on or within the writing utensil 12. Such microchips are currently used for verification purposes when using a debit/credit card. The microchip 25 may also be mounted on the clip 18 of the writing utensil. Finally, FIG. 5 depicts a first plug 24 operationally coupled to the microchip.

A reading means 26 reads the information on the storage medium. Preferably, the reading means 26 includes a housing having a port 28 extending therein adapted for receiving the clip 18. The reading means 26 for the first embodiment would read the magnetic strip 20 in a manner similar to credit card reading devices. The reading means 26 in the second embodiment uses a receiver 30 for receiving the transmitted signal from the transmitting device. The reading means in the third embodiment utilizes a second plug 32 for operationally coupling to the first plug 24. As with conventional credit card readers, the reading means is in communication with a processing center for processing the credit information.

In use, the device 10 is used as a conventional credit card for imparting credit line information to a reading means. The user also has the ability to use the device as a conventional writing utensil. Identification indicia 34 may be positioned on the writing utensil 12 to identify the owner of the writing utensil 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A writing utensil and credit information holding device comprising:

a writing utensil having a first end and a second end, said second end defining an ink delivering portion, a clip being pivotally coupled to said first end of said writing utensil;

a storage medium for storing credit information being attached to said clip, said storage medium comprising a magnetic strip; and a reading means for reading said information on said storage medium, said reading means including a housing having a port extending therein, said port being adapted for receiving said clip.

2. A writing utensil and credit information holding device comprising:

a writing utensil having a first end and a second end;

a storage medium for storing credit information being attached to said writing utensil; and a reading means for reading said information on said storage medium.

3. The writing utensil and credit information holding device as in claim 2 wherein said storage medium comprises a magnetic strip.

4. The writing utensil and credit information holding device as in claim 2, wherein said storage medium comprises a microchip.

5. The writing utensil and credit information holding device as in claim 4, wherein said microchip transmits and receives information by a wireless signal with said reading means.

6. The writing utensil and credit information holding device as in claim 4, wherein said clip has a first plug thereon operationally coupeled to said microchip, said reading means including a second plug thereon for operationally coupled to said first plug such that said reading means may transfer information with said microchip.

7. The writing utensil and credit information holding device as in claim 4, wherein said microchip is placed on said clip for positioning within a port located on said reading means.

8. A writing utensil and credit information holding device comprising:

a writing utensil having a first end and a second end, said second end defining an ink delivering portion, a clip being pivotally coupled to said first end of said writing utensil;

a storage medium for storing credit information being attached to said writing utensil, said storage medium comprising a microchip; and a reading means for reading said information on said storage medium.

* * * * *